US006263777B1

(12) United States Patent
Lauder

(10) Patent No.: US 6,263,777 B1
(45) Date of Patent: Jul. 24, 2001

(54) CONTROL SYSTEM FOR RECIPROCATING DEVICE

(75) Inventor: Arthur W. Lauder, Edmonton (CA)

(73) Assignee: Plainsman Mfg. Inc., Edmonton (CA)

( * ) Notice: Subject to any disclaimer, the term of this patent is extended or adjusted under 35 U.S.C. 154(b) by 0 days.

(21) Appl. No.: 09/500,076

(22) Filed: Feb. 8, 2000

(51) Int. Cl.[7] ..... F01L 31/02
(52) U.S. Cl. ..... 91/346; 91/350
(58) Field of Search ..... 91/350, 352, 345, 91/346

(56) References Cited

U.S. PATENT DOCUMENTS

| | | | | |
|---|---|---|---|---|
| 51,454 | * | 12/1865 | Guild et al. | 91/350 X |
| 886,442 | * | 5/1908 | Tittle | 91/350 X |
| 933,637 | * | 9/1909 | Farrell | 91/350 X |
| 1,750,634 | * | 3/1930 | Forsberg | 91/350 X |
| 3,561,325 | * | 2/1971 | Lamb et al. | 91/350 X |
| 3,598,019 | * | 8/1971 | Killian | 91/350 X |

FOREIGN PATENT DOCUMENTS

| | | | | |
|---|---|---|---|---|
| 458221 | * | 7/1949 | (CA) | 91/350 |
| 164925 | * | 6/1921 | (GB) | 91/350 |
| 305686 | * | 1/1929 | (GB) | 91/350 |

* cited by examiner

*Primary Examiner*—John E. Ryznic
(74) *Attorney, Agent, or Firm*—Anthony R. Lambert

(57) ABSTRACT

A control system for a reciprocating device. The control system includes a switching valve having a fluid supply inlet, an exhaust outlet, a restrictor on the exhaust outlet, a drive line, a valve operable to connect one of the exhaust outlet and the fluid supply inlet to the drive line and a toggle for operating the valve, the toggle being movable by motive force through an arc between a first position in which fluid flow is from the fluid supply inlet to the drive line and a second position in which fluid flow is from the drive line to the exhaust outlet, the toggle passing through a middle position where fluid flow may flow from the drive line to the exhaust outlet and from the fluid supply inlet to the drive line. A reciprocating device is provided that is operable to move in a first direction due to fluid pressure in the drive line and a second, opposed, direction due to a motive force activator when pressure in the drive line is reduced (exhausted). A trigger on the reciprocating device moves with the reciprocating device. A connector is disposed between the trigger and the toggle. The connector being operable to move the toggle into the first position when moving in the second direction and to move the toggle into the second position when moving in the first direction. The connector includes a spring arranged to transmit forces from the trigger to the toggle when the trigger is moving in the first or second direction (or both, with two springs), the spring storing energy while moving in the first or second direction to force the toggle through the middle position.

14 Claims, 3 Drawing Sheets

CONTROL SYSTEM FOR RECIPROCATING DEVICE

FIELD OF THE INVENTION

This invention relates to control systems for reciprocating devices.

BACKGROUND OF THE INVENTION

Some conventional switching valves have a toggle that is operated by a trigger on a reciprocating unit to change the direction of movement of the reciprocating unit. The toggle is used to operate a valve that directs fluid flow into or away from a diaphragm (piston or like device) that operates the reciprocating unit. The toggle passes through a middle position where flow is only partially directed to the middle position. In this partial flow position, at low speeds of operation, the toggle may become stuck in a flutter mode where the reciprocating unit oscillates over a much reduced range of motion, insufficient to drive the toggle into a fully switched position in either direction. The present invention is intended to overcome this problem with such prior art switching valves.

SUMMARY OF THE INVENTION

Therefore, according to an aspect of the invention, there is provided a control system for a reciprocating device. The control system includes a switching valve having a fluid supply inlet, an exhaust outlet, a restrictor on the exhaust outlet, a drive line, a valve operable to connect one of the exhaust outlet and the fluid supply inlet to the exhaust outlet and a toggle for operating the valve, the toggle being movable by motive force through an arc between a first position in which fluid flow is from the fluid supply inlet to the drive line and a second position in which fluid flow is from the drive line to the exhaust outlet, the toggle passing through a middle position where fluid flow may flow from the drive line to the exhaust outlet and from the fluid supply inlet to the drive line. A reciprocating device is provided that is operable to move in a first direction due to fluid pressure in the drive line and a second, opposed, direction due to a motive force activator when pressure in the drive line is reduced. A trigger on the reciprocating device moves with the reciprocating device. A connector is disposed between the trigger and the toggle. The connector being operable to move the toggle into the first position when moving in the second direction and to move the toggle into the second position when moving in the first direction. The connector includes a spring or springs arranged to transmit forces from the trigger to the toggle when the trigger is moving in one or both of the first direction and the second direction, the spring storing energy while moving in the one or both of the first direction and the second direction to force the toggle through the middle position.

The connector preferably comprises a pivoting member, the pivoting member having a trigger opening for receiving the trigger and a toggle opening for receiving the toggle, the spring being located adjacent the opening for receiving the toggle. The trigger opening is preferably on a side of the pivoting member opposed to the toggle opening. The pivot is preferably disposed between the toggle opening and the trigger opening. The pivoting member is preferably a plate and the spring is housed in a slot that terminates at the toggle opening. The spring is preferably secured in the slot by a slider and a stop. The pivot is preferably fastened to the toggle valve.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, "comprising" means "including". In addition, a reference to an element by the indefinite article "a" does not exclude the possibility that more than one of the element is present.

Figure 1:
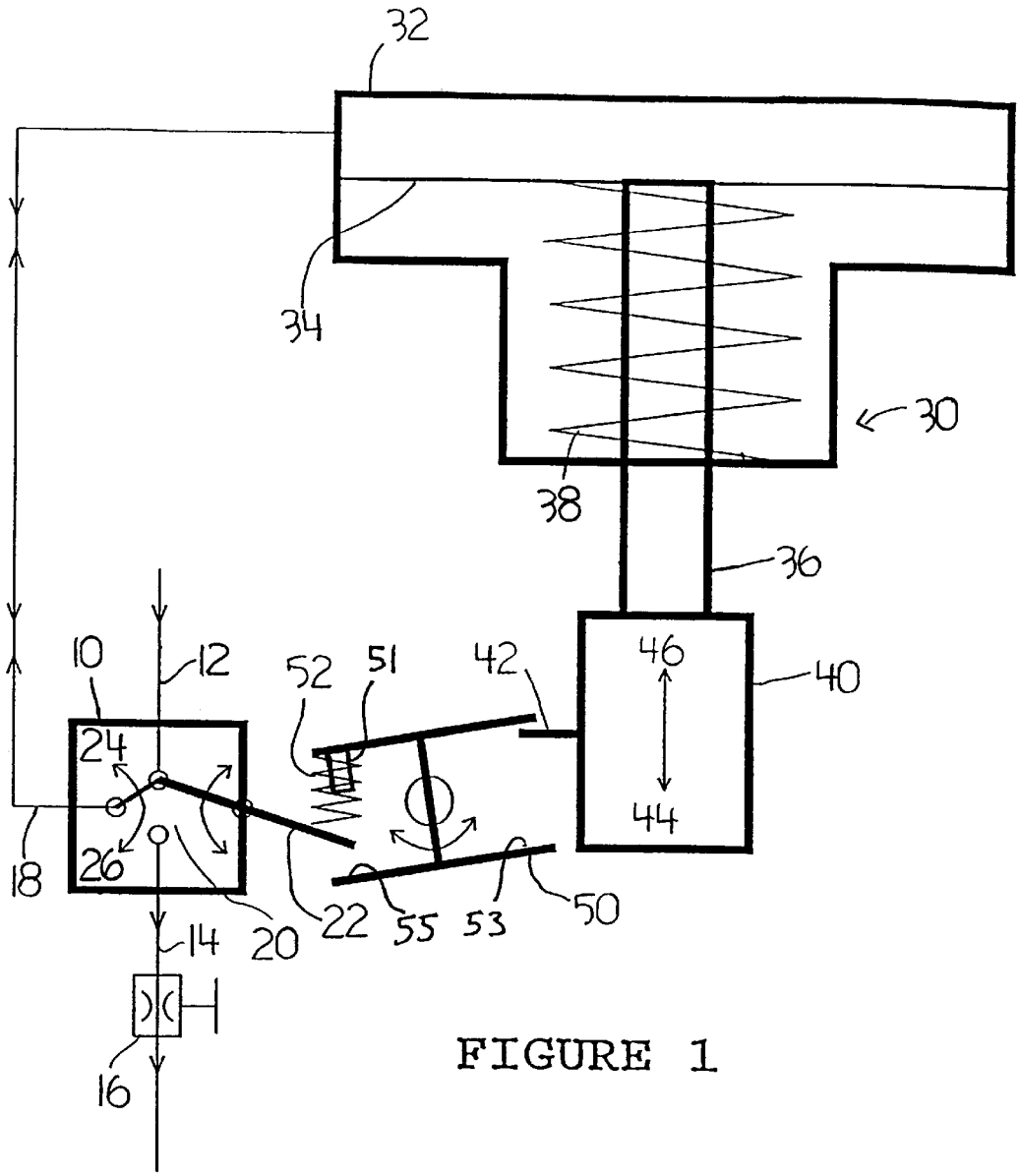
FIG. 1 shows a schematic of a control system for a pump according to the invention.

Referring to FIG. 1, there is shown a control system for a reciprocating device. In this case, the reciprocating device is a pump, although the pump components are not shown. A conventional switching valve 10 has a fluid supply inlet 12, an exhaust outlet 14, a restrictor 16 on the exhaust outlet 14, a drive line 18, a valve 20 operable to connect one of the fluid supply inlet 12 and the exhaust outlet 14 to the drive line 18 and a toggle 22 for operating the valve 20. All of these parts are conventional and available in numerous valve switches. As is common in these devices, the toggle 22 is movable by motive force through an arc between a first position 24 in which fluid flow is from the fluid supply inlet 12 to the drive line 18 and a second position 26 in which fluid flow is from the drive line 18 to the exhaust outlet 14. The toggle 22 passes through a middle position where both the exhaust outlet 14 and supply inlet 12 are open to fluid communication with the drive line 18.

The switching valve 10 is used to control a reciprocating device 30. The reciprocating device 30 includes a diaphragm housing 32, a diaphragm 34, a diaphragm rod 36, a motive force activator such as a return spring 38, a trigger block 40 on the diaphragm rod 36 and a trigger 42 attached to the trigger block 40 at a point on the diaphragm rod 36 away from the diaphragm 34. The trigger 42 is thus arranged to move with the reciprocating rod 36. The reciprocating device is conventional, and is operable to move in a first direction 44 due to fluid pressure in the drive line 18 and a second, opposed, direction 46 due to the motive force activator 46 when pressure in the drive line 18 is reduced (that is, exhausted).

A connector 50 is provided between the trigger 42 and the toggle 22. An example of a connector 50 is shown in FIG. 1, although a preferred design is shown in FIGS. 2–5. The connector 50 is operable to move the toggle 22 into the first position 24 when moving in the second direction 46 and to move the toggle into the second position 26 when moving in the first direction 44. The connector 50 includes a spring 52 (shown symbolically in FIG. 1) arranged to transmit forces from the trigger 42 to the toggle 22 when the trigger 42 is moving in the second direction 46. The spring 52 stores energy while moving in the second direction 46 to force the toggle 22 through the middle position.

As shown in FIGS. 2–5, the connector 50 is preferably formed of a pivoting plate 54 that pivots about a carriage bolt 56. The carriage bolt 56 is conveniently secured to the switching valve 10 via a cover plate 58. A spacer 60 separates the pivoting plate 54 and cover plate 58. The pivoting plate 54 is conveniently held on the carriage bolt 56 by a spring 62, nut 64 and washer 66.

Figures 2, 3, 4:
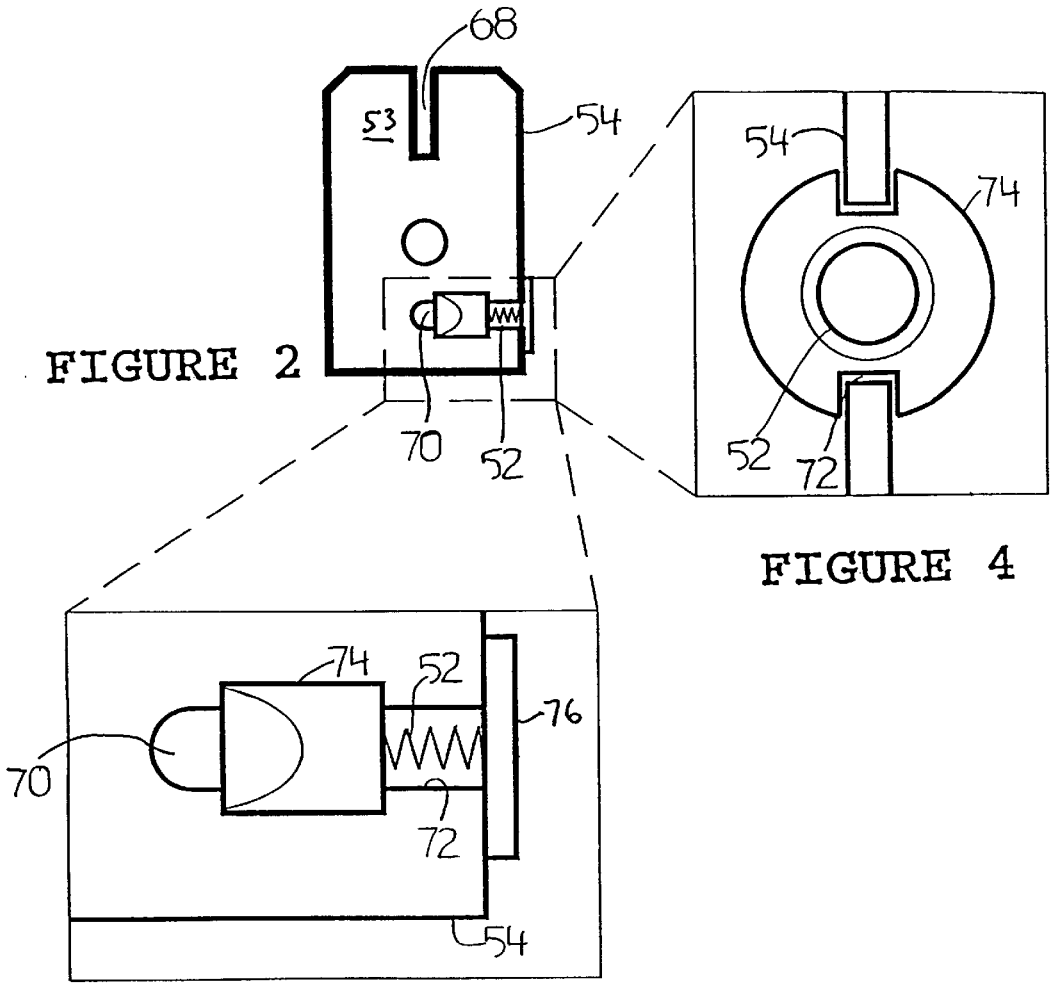
FIG. 2 is a plan view of a connector for use with the control system of FIG. 1.
FIG. 3 is an enlarged view of a portion of the connector of FIG. 2.
FIG. 4 is a side view, enlarged, of a portion of the connector of FIG. 2.
Figure 5:
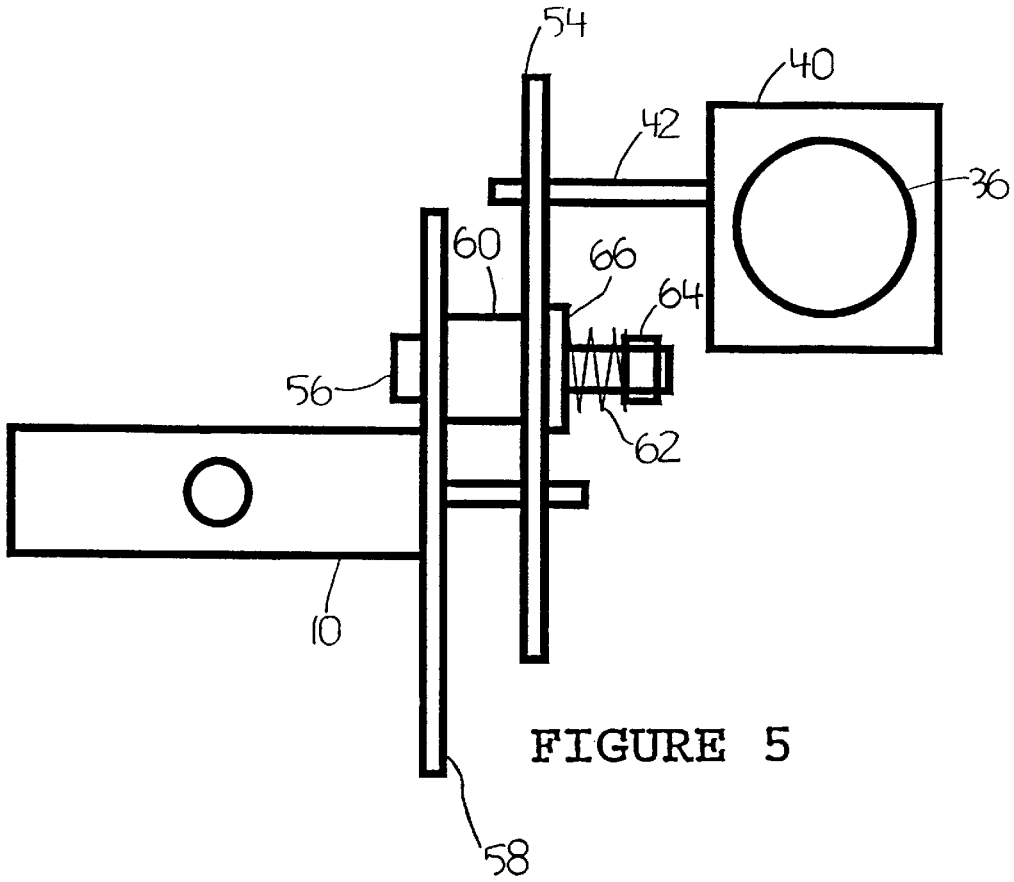
FIG. 5 is a detailed side view of an exemplary arrangement of a connector according to the invention between a toggle and trigger.

The pivoting plate 54 has a trigger opening 68, preferably a slot as shown, for receiving the trigger 22 and a toggle opening 70 for receiving the toggle 42. The spring 52 is located adjacent the opening 70 for receiving the toggle 42. The trigger opening 68 is preferably on a side of the pivoting plate 54 opposed to the toggle opening 70 as shown in FIG. 2, with the carriage bolt 56 disposed between the toggle opening 70 and the trigger opening 68. The spring 52 is preferably housed in a slot 72 that terminates at the toggle opening 70. The spring 52 is secured in the slot 72 by a cylindrical slider 74 and a stop 76, which may be welded to the plate 54.

In operation, the switch 10 is manually operated to commence flow of fluid, for example air from a conventional pneumatic supply, from the fluid supply inlet 12 to the drive line 18. The rate of fluid flow into the drive line 18 is governed by the pressure in the fluid supply. As fluid enters the diaphragm housing 32, the diaphragm drives the rod 36 in the first direction 44. Trigger 42 engages connector 50 (plate 54), which in turn engages toggle 22 and forces it into the second position 26. In the second position, fluid in the drive line 18 is exhausted through the exhaust outlet that is controlled by the exhaust restrictor 16. The return spring 38 urges the rod 36 in the second direction 46, and the trigger 42 engages the connector 50 (plate 54), which presses on the spring 52 to drive the toggle 42 towards the first position. At the beginning of movement in the second direction, energy is stored in the spring 52. The amount of energy stored in the spring 52 is determined by the spring constant and the length of compression of the spring 52 before the spring 52 stops compressing upon the toggle 42 reaching the stop 76. The stop 76 is shown schematically in FIG. 1 as element 51. If the rate of movement is low (relatively low rate of exhaust), the trigger 42 begins to find itself trapped between oscillating flow in the drive line 18 and the force of the return spring 38. The spring 52 then releases its stored energy and drives the toggle 22 into the first position. Fluid then flows from the supply inlet 12 to the drive line 18 and the cycle begins again and repeats until the fluid pressure is turned off. The choice of the strength of spring 52 is readily determined.

The spring 52 may also be located in an equivalent slot at the trigger side 53 of the plate 54. The device may also be arranged to operate in either or both directions of movement of the rod 36, by placing the toggle slot 70 with the spring 52 (or an additional slot 70 and spring 52) on the opposite side of the plate 54, at the location illustrated schematically in FIG. 1 by numeral 55. In this case, useful for the situation when the rod 36 also moves slowly in the first direction, the spring 52 transmits forces from the trigger 42 to the toggle 22 when the trigger 42 is moving in the first direction 44 (outward from the diaphragm), and thus the spring 52 in this instance stores energy while moving in the first direction to force the toggle 22 through the middle position. Likewise, a spring could be provided on the other side of the trigger.

Immaterial modifications may be made to the invention described here without departing from the essence of the invention. As for example, various configurations of spring and slot may be used in a plate or similar member. Also, the trigger block may be formed as a ring, or other suitable device for holding the trigger.

The embodiments of the invention in which an exclusive property or privilege is claimed are defined as follows:

1. A control system for a reciprocating device, the control system comprising:

a switching valve having a fluid supply inlet, an exhaust outlet, a restrictor on the exhaust outlet, a drive line, a valve operable to connect one of the exhaust outlet and the fluid supply inlet to the exhaust outlet and a toggle for operating the valve, the toggle being movable by motive force through an arc between a first position in which fluid flow is from the fluid supply inlet to the drive line and a second position in which fluid flow is from the drive line to the exhaust outlet, the toggle passing through a middle position where fluid flow may flow from the drive line to the exhaust outlet and from the fluid supply inlet to the drive line;

a reciprocating device that is operable to move in a first direction due to fluid pressure in the drive line and a second, opposed, direction due to a motive force activator when pressure in the drive line is reduced;

a trigger on the reciprocating device that moves with the reciprocating device;

a connector between the trigger and the toggle, the connector being operable to move the toggle into the first position when moving in the second direction and to move the toggle into the second position when moving in the first direction; and the connector including a spring arranged to transmit forces from the trigger to the toggle when the trigger is moving in the second direction, the spring storing energy while moving in the second direction to force the toggle through the middle position.

2. The control system of claim 1 in which the connector comprises a pivoting member, the pivoting member having a trigger opening for receiving the trigger and a toggle opening for receiving the toggle, the spring being located adjacent the opening for receiving the toggle.

3. The control system of claim 2 in which the trigger opening is on a side of the pivoting member opposed to the toggle opening.

4. The control system of claim 3 in which the pivoting member has a pivot, and the pivot is disposed between the toggle opening and the trigger opening.

5. The control system of claim 2 in which the pivoting member is a plate and the spring is housed in a slot that terminates at the toggle opening.

6. The control system of claim 5 in which the spring is secured in the slot by a slider and a stop.

7. The control system of claim 2 in which the pivot is fastened to the toggle valve.

8. A control system for a reciprocating device, the control system comprising:

a switching valve having a fluid supply inlet, an exhaust outlet, a restrictor on the exhaust outlet, a drive line, a valve operable to connect one of the exhaust outlet and the fluid supply inlet to the exhaust outlet and a toggle for operating the valve, the toggle being movable by motive force through an arc between a first position in which fluid flow is from the fluid supply inlet to the drive line and a second position in which fluid flow is from the drive line to the exhaust outlet, the toggle passing through a middle position where fluid flow may flow from the drive line to the exhaust outlet and from the fluid supply inlet to the drive line;

a reciprocating device that is operable to move in a first direction due to fluid pressure in the drive line and a second, opposed, direction due to a motive force activator when pressure in the drive line is reduced;

a trigger on the reciprocating device that moves with the reciprocating device;

a connector between the trigger and the toggle, the connector being operable to move the toggle into the first position when moving in the second direction and to move the toggle into the second position when moving m the first direction; and the connector including a spring arranged to transmit forces from the trigger to the toggle when the trigger is moving in the first direction, the spring storing energy while moving in the first direction to force the toggle through the middle position.

9. The control system of claim 8 in which the connector comprises a pivoting member, the pivoting member having a trigger opening for receiving the trigger and a toggle opening for receiving the toggle, the spring being located adjacent the opening for receiving the toggle.

10. The control system of claim 9 in which the trigger opening is on a side of the pivoting member opposed to the toggle opening.

11. The control system of claim 10 in which the pivoting member has a pivot, and the pivot is disposed between the toggle opening and the trigger opening.

12. The control system of claim 9 in which the pivoting member is a plate and the spring is housed in a slot that terminates at the toggle opening.

13. The control system of claim 12 in which the spring is secured in the slot by a slider and a stop.

14. The control system of claim 9 in which the pivot is fastened to the toggle valve.

* * * * *